US009026023B2

(12) United States Patent
Gon et al.

(10) Patent No.: US 9,026,023 B2
(45) Date of Patent: May 5, 2015

(54) FIXING DEVICE AND IMAGE FORMING APPARATUS HAVING THE SAME

(71) Applicant: KYOCERA Document Solutions Inc., Osaka-shi (JP)

(72) Inventors: Syoko Gon, Osaki (JP); Makoto Egi, Osaki (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/919,808

(22) Filed: Jun. 17, 2013

(65) Prior Publication Data

US 2013/0336691 A1 Dec. 19, 2013

(30) Foreign Application Priority Data

Jun. 19, 2012 (JP) ..... 2012-137851

(51) Int. Cl.
*G03G 15/20* (2006.01)

(52) U.S. Cl.
CPC ..... *G03G 15/2064* (2013.01); *G03G 15/2053* (2013.01); *G03G 2215/2035* (2013.01)

(58) Field of Classification Search
CPC ..... G03G 15/2064; G03G 15/20; H05B 6/14
USPC ..... 399/329; 219/216, 469, 471
See application file for complete search history.

(56) References Cited

U.S. PATENT DOCUMENTS

| | | | | |
|---|---|---|---|---|
| 5,852,763 | A * | 12/1998 | Okuda et al. | 399/329 |
| 6,597,888 | B1 * | 7/2003 | Abe et al. | |
| 2007/0071521 | A1 * | 3/2007 | Jeong | 399/329 |
| 2008/0175613 | A1 * | 7/2008 | Fukai et al. | 399/67 |

FOREIGN PATENT DOCUMENTS

| | | | |
|---|---|---|---|
| JP | 2001-083822 | A | 3/2001 |
| JP | 2003-280417 | A | 10/2003 |
| JP | 2003-316181 | A | 11/2003 |
| JP | 2005-249958 | A | 9/2005 |

OTHER PUBLICATIONS

Notice of Reasons for Rejection issued to JP Application No. 2012-137851, mailed Jul. 15, 2014.

* cited by examiner

*Primary Examiner* — G. M. Hyder
(74) *Attorney, Agent, or Firm* — Knobbe Martens Olson & Bear LLP

(57) ABSTRACT

A fixing device 5 includes a belt drive assist mechanism 70 configured to rotationally drive a fixing belt 26. The belt drive assist mechanism 70 is in contact with an inner surface of the fixing belt 26 and an outer diameter of an outer circumferential surface 71*a* is smaller than an inner diameter of the fixing belt 26 when the fixing belt 26 is in a circular shape. In addition, the belt drive assist mechanism 70 includes a cylindrical rotation member 71 and a pressing roller 72. The cylindrical rotation member 71 is rotationally driven by a motor 79. The pressing roller 72 is in pressure contact with the cylindrical rotation member 71 while interposing the fixing belt 26 therebetween and rotates following rotation of the fixing belt 26 rotationally driven by the cylindrical rotation member 71 or the pressure applying roller 19.

7 Claims, 7 Drawing Sheets

FIXING DEVICE AND IMAGE FORMING APPARATUS HAVING THE SAME

INCORPORATION BY REFERENCE

This application is based upon and claims the benefit of priority from the corresponding Japanese Patent Application No. 2012-137851, filed in the Japan Patent Office on Jun. 19, 2012, the entire contents of which are incorporated herein by reference.

BACKGROUND

The present disclosure relates to a fixing device which is employed in a copying machine, printer, facsimile machine, multifunctional peripheral and the like, and an image forming apparatus having the same. The present disclosure particularly relates to a fixing device in which a pressing member is used to press a fixing belt against a pressure applying roller and an image forming apparatus having this fixing device.

An image has hitherto been recorded on an image recording medium in such a manner: A toner image formed on an image carrier such as a photosensitive drum is transferred to an image recording medium. This image recording medium carrying the toner image is conveyed to a fixing device where heat and pressure are applied to the toner image such that the toner image is fixed to the image recording medium. A type of fixing device using a belt for fixing a toner image may be named as an example. This type of device employs an endless fixing belt which is heated and with which a pressure applying roller comes in pressure contact to form a fixing nip. When the image recording medium carrying an unfixed toner image passes through the fixing nip, it is fixed to the recording medium.

In this type of fixing device using a fixing belt, a pressing member is disposed on a side of an inner surface of the fixing belt and presses the fixing belt against the pressure applying roller, so that a fixing nip is formed between the fixing belt and the pressure applying roller. The rotationally driven pressure applying roller causes the inner surface of the fixing belt to slide relative to the pressing member, such that the fixing belt is driven to rotate. When the rotationally driven pressure applying roller drives the fixing belt to rotate, it has occurred that the fixing belt slips and does not smoothly rotate depending on an amount of frictional resistance between the pressure applying roller and the fixing belt. The slippage has occurred when an amount of frictional resistance between the pressure applying roller and the fixing belt or between the image recording medium and the fixing belt is smaller than an amount of sliding resistance between the fixing belt and the pressing member.

Techniques related to solving the problem of slippage of a fixing belt have hitherto been known. With respect to the above-mentioned type of fixing by a belt provided with the pressing member, a first example having an end cap and a gear is known. The end cap mates with an opening at an end of the endless fixing belt in a direction of a rotational shaft. The gear is configured to be integral with the end cap. This gear meshes with a drive gear, which meshes with a roller gear that drives the pressure applying roller to rotate. Rotation of the pressure applying roller causes the end cap to rotate via a gear train. It is so configured that the fixing belt rotates following rotation of the pressure applying roller and rotation of the end cap causes the fixing belt to rotate substantially at the same speed of the pressure applying roller. In this manner, the problem of slippage of the fixing belt is solved.

In addition, with respect to the type of fixing by a belt having a pressing member, a second example is known, in which a drive roller configured to drive a fixing belt to rotate is employed in addition to a pressure applying roller. In this example, two drive rollers are disposed coaxially with the pressure applying roller axially outside both ends of the pressure applying roller. The two drive rollers are in pressure contact with flange members while interposing the fixing belt therebetween, the flange members being configured to be rotatable outside a region of a fixing nip. The fixing belt rotates following not only rotation of the pressure applying roller rotationally driven by a drive source, but also rotation of the drive rollers. Since a rotational driving force applied to the fixing belt increases in this manner, it is possible to prevent the fixing belt from slipping.

In addition, with respect to the type of fixing by a belt having a pressing member, a third example is known, in which flange members are attached to both ends of an endless fixing belt in such a manner that the flange members are mated around an outer surface of the fixing belt. When a pressing member and a pressure applying roller comes in pressure contact with each other to form a fixing nip, the fixing nip causes the fixing belt to change its shape into an elliptic shape, so that an outer surface of the fixing belt comes in tight contact with inner surfaces of the flange members. Accordingly, rotational driving forces of the rotationally driven flange members are transmitted to the fixing belt. Since the rotational driving forces of the flange members, which are added to a rotational driving force of the pressure applying roller, assist rotation of the fixing belt, it is possible to prevent the fixing belt from slipping.

However, in the first example of the fixing device, the fixing belt has variations in a shape of deformation in an axial direction, since the fixing belt changes its shape at the fixing nip according to a shape of the fixing nip, whereas the fixing belt changes its shape into a circular shape at an axial end of the fixing belt. If the fixing belt repeats rotation under the condition described above, it may be that as a compressive stress and a tensile stress act on the fixing belt, the fixing belt suffers from stress destruction. On the other hand, if the end cap is arranged spaced much away from the fixing nip to decrease the stress due to extension and contraction of the fixing belt, it will lead to a problem of a dimensional increase of the device in a direction of a rotation shaft.

In the second example of a fixing device, it may be that costs increase due to more time required for processing the fixing belt, since a treatment is applied to the fixing belt such that surface roughness of the fixing belt differs between the fixing nip and a part in pressure contact with the drive roller. With applying the treatment, the amount of the frictional resistance is adapted to be larger for the part of the fixing belt in pressure contact with the drive roller The third example of a fixing device, in which the outer surface of the fixing belt comes in tight contact with the inner surface of the flange member when the fixing belt changes its shape into an elliptic shape, has a problem that the rotational driving force is not sufficiently transmitted from the flange members to the fixing belt.

SUMMARY

In an aspect of the present disclosure, a fixing device is provided, which includes an endless fixing belt heated by a heating part, a pressing member, a pressure applying roller, and a belt drive assist mechanism. The pressing member is disposed on a side of an inner surface of the fixing belt and the inner surface is configured to slide along an outer surface of the pressing member. The pressure applying roller is configured to press the pressing member to form a fixing nip at which the fixing belt is interposed and rotationally driven. The belt drive assist mechanism is disposed outside a nip region of the fixing nip and configured to rotationally drive the fixing belt. The belt drive assist mechanism includes a cylindrical rotation member and a pressing roller. The cylindrical rotation member is configured to be rotationally driven by a drive source. The cylindrical rotation member is configured to be in contact with the inner surface of the fixing belt and to have an outer circumferential surface, a diameter of which is smaller than an inner diameter of the fixing belt for a case where the fixing belt is in a circular shape. The pressing roller is configured to be in pressure contact with the cylindrical rotation member while interposing the fixing belt therebetween and to rotate following rotation of the fixing belt that is driven by the cylindrical rotation member or the pressure applying roller.

In another aspect of the present disclosure, an image forming apparatus is provided, which includes the fixing device described above.

DETAILED DESCRIPTION

Embodiments of the present disclosure will be described with reference to the drawings. The present disclosure will not be limited to these embodiments. In addition, the use of the present disclosure and terms hereinafter referred to are exemplarily described and will not be limited thereto.

First Embodiment

Figure 1:
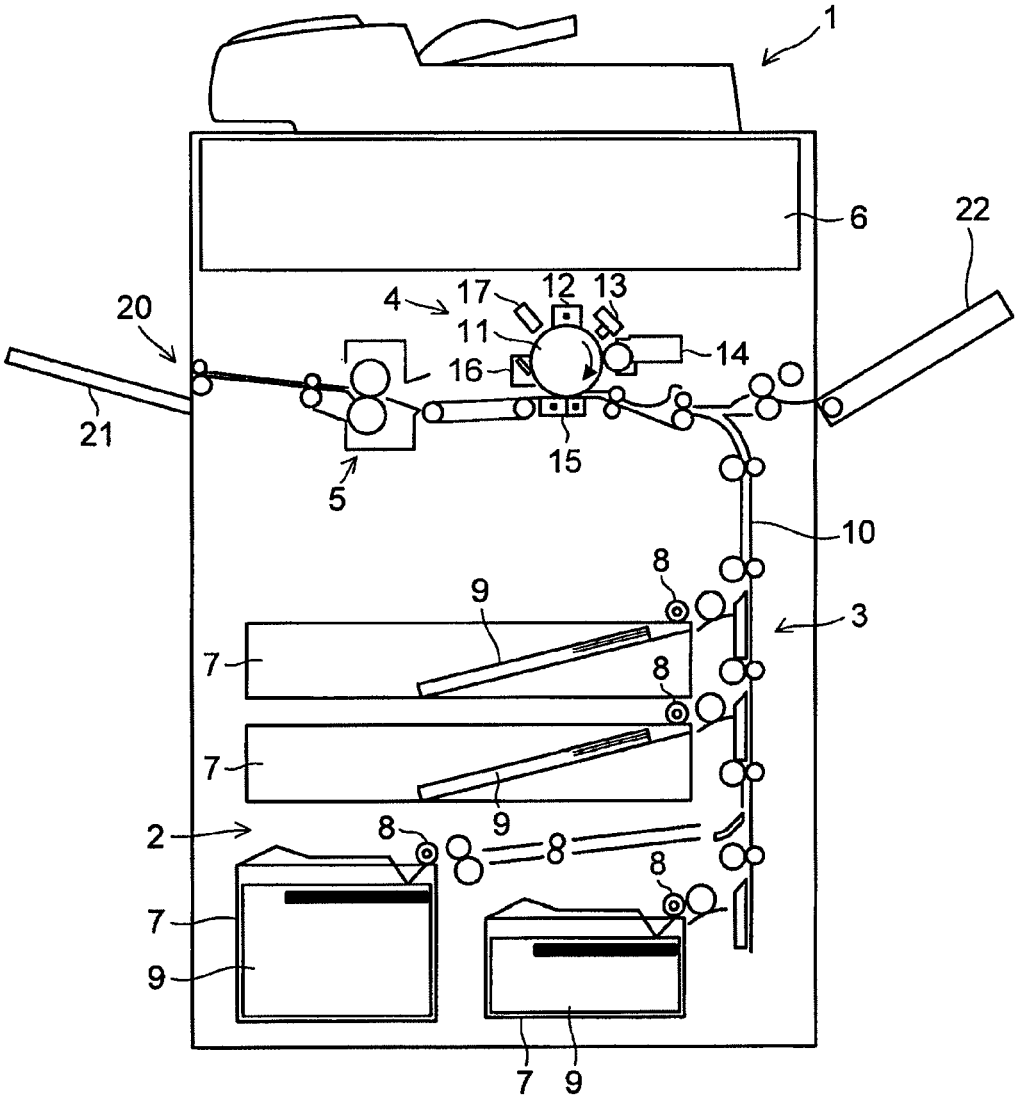
FIG. 1 illustrates a schematic setup of an image forming apparatus including a fixing device according to a first embodiment of the present disclosure.

As shown in FIG. 1, an image forming apparatus 1 includes a feeding part 2, a conveying part 3, an image forming part 4, a fixing device 5, and an image reading part 6. The feeding part 2 is disposed at a lower portion of the image forming apparatus 1. The conveying part 3 is disposed at a side portion with respect to the feeding part 2. The image forming part 4 is disposed over the conveying part 3. The fixing device 5 is disposed downstream of the image forming part 4 in a direction of conveying a sheet of paper. The image reading part 6 is disposed over the image forming part 4 and the image fixing device 5.

The feeding part 2 includes a plurality of feeding cassettes 7 configured to accommodate sheets of paper 9, an example of a recording medium, and a manual feeding tray 22 through which a sheet of paper is manually supplied. The feeding part 2 feeds the sheets of paper 9 one by one to the conveying part 3 by rotation of a feeding roller 8 from a feeding cassette 7 selected out of the plurality of feeding cassettes 7. A sheet of paper which differs in size from a sheet of paper 9 accommodated in the feeding cassette 7, an envelope, an over head projector (OHP) sheet or the like, is placed on the manual feeding tray 22. The manual feeding tray 22 feeds it to the conveying part 3.

The sheet of paper 9 fed to the conveying part 3 is conveyed to the image forming part 4 via a sheet conveying path 10. The image forming part 4 forms a toner image on the sheet of paper 9 through a process of electrophotography. The image forming part 4 includes a photosensitive body 11 supported rotatable in a direction shown by an arrow in FIG. 1. In addition, the image forming part 4 includes a charging part 12, an exposing part 13, a developing part 14, a transferring part 15, a cleaning part 16 and a neutralizing part 17, which are disposed around the photosensitive body 11 in a rotational direction thereof.

The charging part 12 has a charging wire. When a high voltage is imposed on the charging wire, a corona discharge, occurs. Accordingly, the charging part 12 applies a predetermined voltage to a surface of the photosensitive body 11, so that the surface is uniformly charged. When the exposing part 13 illuminates light that carries image data of a document read by the image reading part 6 on the surface of the photosensitive body 11, the voltage on the surface of the photosensitive body 11 is selectively attenuated, such that an electrostatic latent image is formed on the surface of the photosensitive body 11.

Subsequently, the developing part 14 develops the electrostatic latent image on the surface of the photosensitive body 11 and a toner image is formed on the surface of the photosensitive body 11, accordingly. The toner image is transferred by the transferring part 15 to a sheet of paper 9 supplied between the photosensitive body 11 and the transferring part 15.

The sheet of paper 9 on which the toner image has been transferred is conveyed to the fixing device 5, which is disposed downstream of the image forming part 4 in a direction of conveying a sheet. The sheet of paper 9 is heated and pressed by the fixing device 5, such that the toner image is fused and fixed on the sheet of paper 9. Subsequently, the sheet of paper 9 on which the toner image is fixed is discharged onto a discharging tray 21 by a pair of discharging rollers 20.

After the toner image is transferred to the sheet of paper 9 by the transferring part 15, toner remaining on the surface of the photosensitive body 11 is removed by the cleaning part 16. An electric charge remaining on the surface of the photosensitive body 11 is removed by the neutralizing part 17. The photosensitive body 11 is again charged by the charging part 12, and image forming is continued in a similar manner.

Figure 2:
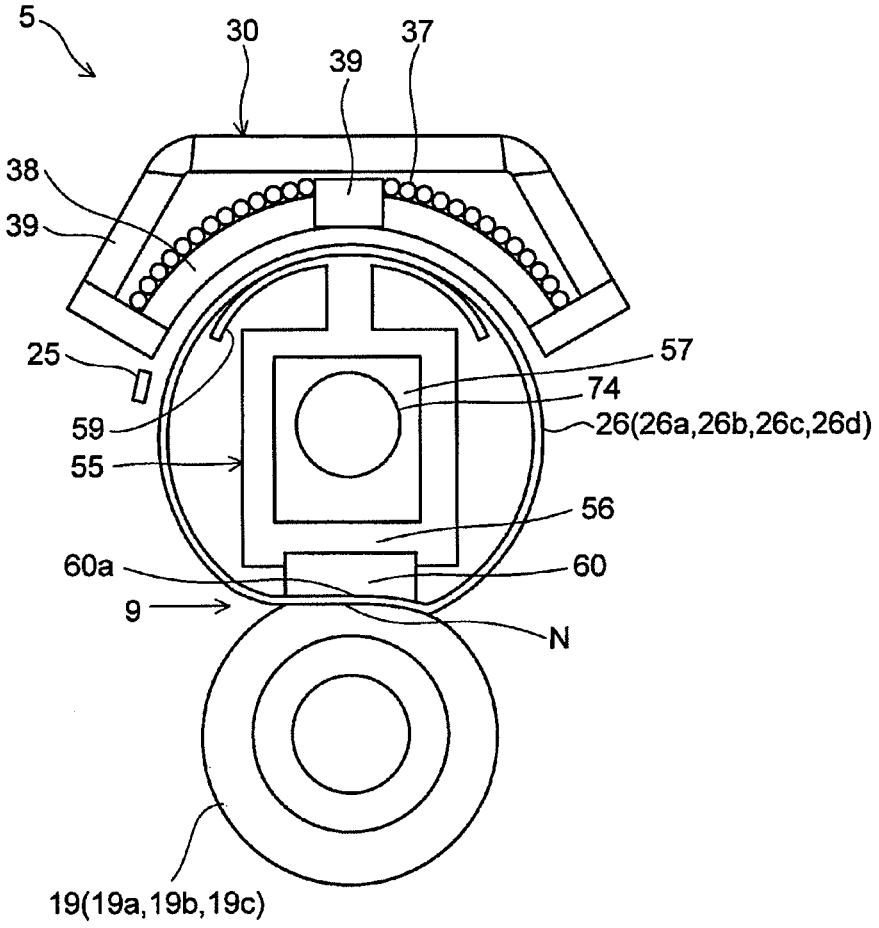
FIG. 2 is a cross sectional view showing the fixing device according to the first embodiment.

FIG. 2 is a cross sectional view schematically illustrating the fixing device 5. It should be noted that a direction of conveying a sheet is from left to right, opposite to that of FIG. 1, since FIG. 2 shows the fixing device 5 when viewed on a rear side of the image forming apparatus 1 (reverse side of FIG. 1).

The fixing device 5 employs a type of fixing with electromagnetic induction heating and includes a fixing belt 26, a pressure applying roller 19, an electromagnetic induction heating part 30 to heat the fixing belt 26, a thermistor 25 of a temperature detector and a belt supporting member 55.

The fixing belt 26 is a heat resistant endless belt, which has layers in order of inner to outer surface, a sliding layer 26*a*, an inductively heat generating layer 26*b*, an elastic layer 26*c* and a separation layer 26*d*. The sliding layer 26*a* is made of a layer of PFA or PTFE. The inductively heat generating layer 26*b* is a base layer made of electroforming nickel. The elastic layer 26*c* is made of silicone rubber and the like. The separation layer 26*d*, which is made of a fluorocarbon polymer and the like, facilitates a release characteristic at a time of fusing and fixing an unfixed toner image at a fixing nip N. In this connection, it may be that the inductively heat generating layer 26*b* is made of a polyimide resin into which a metallic powder such as copper, silver or aluminum alloy is mixed.

The belt supporting member 55 made of a metal such as aluminum alloy or a heat resistant resin includes a belt holding part 59, a pad holding part 56 and a cavity 57. The belt holding part 59 has a shape of curvature when viewed in a cross section and holds the fixing belt 26 a predetermined distance away from the induction heating part 30. The pad holding part 56 holds a press pad 60 of a press member. A shaft 74 of a belt drive assist mechanism 70 (see FIG. 3) to be described later penetrates the cavity 57.

The press pad 60 is made of a heat resistant resin such as a liquid crystal polymer resin or an elastic material such as silicone rubber and is disposed opposite to the pressure applying roller 19, interposing the fixing belt 26 therebetween. A sliding surface 60*a*, which an inner surface of the fixing belt 26 slidably rubs, is formed on the press pad 60. In this connection, it may be that the pad holding part 56 is configured to be separate from the belt holding part 59, such that the pad holding part 56 is supported by a main body of the fixing device 5.

The sliding surface 60*a* has a flat portion and a curved portion. The flat portion extends in a direction parallel with the direction of conveying a sheet at an upstream region. The curved portion has a radius of curvature greater than that of the pressure applying roller 19 formed more downstream than the flat portion in the direction of conveying a sheet. In addition, the curved portion is concave toward the pressure applying roller 19. In this connection, it may be that a sliding member (not illustrated) of a fluorocarbon polymer such as a PTFE sheet is interposed between the sliding surface 60*a* and the fixing belt 26, such that a frictional load therebetween decreases.

The pressure applying roller 19 includes a cylindrical cored bar 19*a* made of an iron alloy and the like, an elastic layer 19*b* made of silicone rubber formed on a surface of the cored bar 19*a*, and a separation layer 19*c* made of a fluorocarbon polymer and the like coating a surface of the elastic layer 19*b*. The pressure applying roller 19 is in pressure contact with the press pad 60 while interposing the fixing belt 26 therebetween and rotationally driven clockwise by a driving source (not illustrated) such as a motor. When the pressure applying roller 19 rotates while the pressure applying roller 19 and the press pad 60 interpose the fixing belt 26 therebetween, the fixing belt 26 is driven to rotate. A fixing nip N is formed at a portion where the pressure applying roller 19 is in pressure contact with the fixing belt 26. An unfixed toner image on a conveyed sheet of paper 9 is heated and pressed, so that the toner image is fixed on the sheet of paper 9.

The induction heating part 30 includes an exiting coil 37, a supporting member 38 and a magnetic core 39, and applies heat to the fixing belt 26 by electromagnetic induction. The induction heating part 30 is arranged opposite to the fixing belt 26 such that it extends in a direction of a rotation shaft of the fixing belt 26 (a direction perpendicular to the sheet of FIG. 2). Also it is arranged to cover substantially one half of an outer surface of the fixing belt 26

The exiting coil 37, which is formed with a litz wire bent like a loop a plurality of times in a direction of the rotation shaft of the fixing belt 26, is attached to the supporting member 38. The exiting coil 37 is electrically connected with a power supply (not illustrated) and supplied with a high-frequency current, such that the exiting coil 37 generates an alternate magnetic flux. The magnetic flux generated by the exiting coil 37 passes through the magnetic core 39 and is guided in an in-plane direction of FIG. 2, so that the magnetic flux passes through the induction heating layer 26*a* of the fixing belt 26. An eddy current occurs in the induction heating layer 26*a* due to a change in an alternate magnitude of the magnetic flux passing through the induction heating layer 26*a*. When the eddy current flows in the induction heating layer 26*a*, Joule heat is generated by the electric resistance of the induction heating layer 26*a*. Accordingly, the fixing belt 26 generates heat (is heated).

Thermistors 25 are arranged opposite to an outer surface of the fixing belt 26 at a center and both ends thereof, respectively and detect temperatures of respective regions. The current supplied to the exciting coil 37 of the induction heating part 30 is controlled based on the temperatures detected by the thermistors 25.

When the fixing belt 26 is heated by the induction heating part 30 of a heating part and reaches a temperature at which fixing is performable, a sheet of paper 9 nipped at the fixing nip N is heated and pressed by the pressure applying roller 19, so that the toner of powder on the sheet of paper 9 is fused and fixed. The sheet of paper 9 after a fixing process is conveyed while adhering to the surface of the fixing belt 26 and separated from the surface of the fixing belt 26 by a separation member (not illustrated). Subsequently, the sheet of paper 9 is conveyed downstream of the fixing device 5.

The belt drive assist mechanism 70, which will be described later, is arranged at an end of the fixing belt 26 in a direction of the rotation shaft thereof (see FIGS. 3 and 4). When the fixing belt 26 rotates following rotation of the pressure applying roller 19, it may occur that a frictional resistance of a sheet of paper 9 and the fixing belt 26 with respect to the pressure applying roller 19 becomes smaller than a sliding resistance between the fixing belt 26 and the press pad 60. Under such a circumstance, the fixing belt 26 may experience slippage and not rotate at a predetermined circumferential speed. In such a case, the belt drive assist mechanism 70 assists the fixing belt 26 to rotate.

Figure 3:
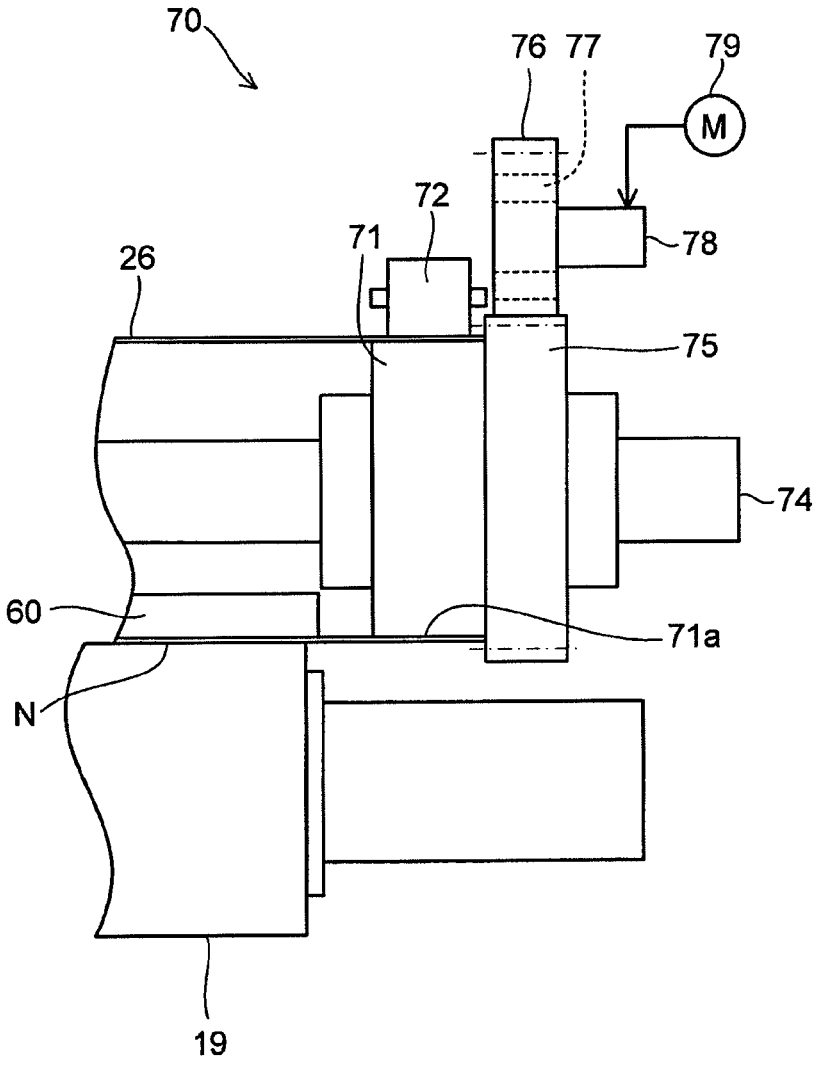
FIG. 3 is a partial side view illustrating a belt drive assist mechanism of the fixing device according to the first embodiment.
Figure 4:
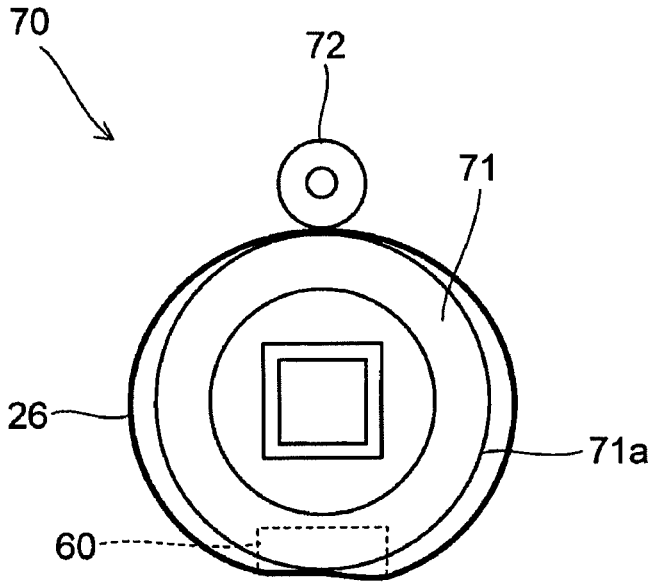
FIG. 4 is a plan view illustrating the belt drive assist mechanism according to the first embodiment.

A detail setup of the belt drive assist mechanism 70 is shown in FIGS. 3 and 4. FIG. 3 is a partial side view illustrating a setup of the belt drive assist mechanism 70 according to the first embodiment. FIG. 4 is a plan view illustrating a setup of the belt drive assist mechanism 70. It should be noted that the fixing belt 26 is shown in a cross section in FIG. 3 and a first gear member 75 and a second gear member 76 shown in FIG. 3 are omitted.

As shown in FIG. 3, the belt drive assist mechanism 70 is arranged at an end of the fixing belt 26 in the direction of the rotation shaft thereof and outside a nip region of the fixing nip N. The belt drive assist mechanism 70 includes a cylindrical rotation member 71, a pressing roller 72, a first gear member 75, a second gear member 76, a one-way clutch 77, and a motor 79 of a drive source.

The cylindrical rotation member 71 has the shaft 74 by which the cylindrical rotation member 71 is rotatably supported at a main body (not illustrated) of the fixing device 5. In addition, the cylindrical rotation member 71 is arranged at the end of the fixing belt 26 in the direction of the rotation shaft thereof and outside the nip region of the fixing nip N. Furthermore, the cylindrical rotation member 71 is placed internally in contact with the fixing belt 26. An outer diameter of an outer circumferential surface 71*a* of the cylindrical rotation member 71, which faces an inner surface of the fixing belt 26, is smaller than an inner diameter of the fixing belt 26 when the fixing belt 26 is in a shape of a circle. Accordingly, the fixing belt 26 mates loosely with the outer circumferential surface 71*a* of the cylindrical rotation member 70.

The pressing roller 72 is arranged opposite to an outer surface of the fixing belt 26 and rotatably supported at the main body (not illustrated) of the fixing device 5. An outer diameter of the pressing roller 72 is smaller than an outer diameter of the cylindrical rotation member 71. In addition, a biasing member such as a spring (not illustrated) causes the pressing roller 72 to be in pressure contact with the cylindrical rotation member 71 while interposing the fixing belt 26 therebetween. Accordingly, the fixing belt 26 rotates in a same direction as the cylindrical rotation member 71, following rotation of the cylindrical rotation member 71. At the same time, the pressing roller 72 rotates in a direction opposite to that of the fixing belt 26, following rotation of the fixing belt 26. The cylindrical rotation member 71 causes the fixing belt 26 to rotate in a same direction as the pressure applying roller 19 causes the fixing belt 26 to rotate.

When the fixing belt 26 rotates following rotation of the pressure applying roller 19 or the cylindrical rotation member 71, the fixing belt 26 changes its shape, as shown in FIG. 4, according to a shape of the sliding surface 60*a* of the press pad 60 (a combination of a plane and a curved surface as shown in FIG. 2) at the fixing nip N. On the other hand, the fixing belt 26 changes its shape according to an arc of the cylindrical rotation member 71 at a pressure contact location between the cylindrical rotation member 71 and the pressing roller 72. Since the fixing belt 26 mates loosely with the cylindrical rotation member 71, a local deformation is absorbed and it is unlikely to suffer stress loading due to the expansion and contraction of the fixing belt 26, solving a possible occurrence of destruction and damage. In addition, as the cylindrical rotation member 71 is arranged inside the fixing belt 26 in a vicinity of the fixing nip N, the fixing device 5 will not increase its size.

With reference to FIG. 3, the first gear member 75 is disposed at the shaft 74 coaxially and integrally with the cylindrical rotation member 71. The first gear member 75 meshes with the second gear member 76 that is rotationally driven by the motor 79.

The second gear member 76 builds in the one-way clutch 77 between the rotation shaft 78 rotated by the motor 79 and a gear part of the second gear member 76 meshing with the first gear member 75.

The one-way clutch 77 selectively enables and disables the transmission of a rotational force from the rotation shaft 78 to the gear part of the second gear member 76. That is, when the fixing belt 26 rotates at a substantially same predetermined circumferential speed Va as the pressure applying roller 19, the one-way clutch 77 does not transmit a rotational force of the rotation shaft 78 (i.e. a rotational force of the motor 79) to the gear part of the second gear member 76 (i.e. cylindrical rotation member 71). On the other hand, when the fixing belt 26 rotates at less than the predetermined circumferential speed Va, the one-way clutch 77 transmits the rotational force of the rotation shaft 78 to the gear part of the second gear member 76.

More specifically, when the fixing belt 26 rotates at the substantially predetermined circumferential speed Va following rotation of the pressure applying roller 19, a rotational speed of the gear part of the second gear member 76 is greater than that of the rotation shaft 78 driven by the motor 79. Accordingly, the one-way clutch 77 runs idle and the rotational force of the rotation shaft 78 is not transmitted to the cylindrical rotation member 71 via the second gear member 76. In contrast, when the fixing belt 26 rotates at less than the predetermined circumferential speed Va following rotation of the pressure applying roller 19, the rotational speed of the gear part of the second gear member 76 is smaller than that of the rotation shaft 78 driven by the motor 79. Accordingly, the one-way clutch 77 comes in a meshed state and the rotational force of the rotation shaft 78 is transmitted to the cylindrical rotation member 71 via the second gear member 76.

When the fixing belt 26 rotates without slippage at the substantially same predetermined circumferential speed Va as the pressure applying roller 19, the one-way clutch 77 does not transmit the rotational force of the motor 79 to the cylindrical rotation member 71. Accordingly, the fixing belt 26 rotates following rotation of the pressure applying roller 19 and a sheet of paper 9 is appropriately conveyed to the fixing nip N. In this manner, unfixed toner carried on the sheet of paper 9 is fixed. In this case, the pressing roller 72, cylindrical rotation member 71, first gear member 75 and second gear member 76 rotate following rotation of the fixing belt 26.

On the other hand, when the fixing belt 26 rotates following rotation of the pressure applying roller 19, it may occur that a frictional resistance between a sheet of paper 9 and the fixing belt 26 becomes smaller than a sliding resistance between the fixing belt 26 and the press pad 60. When the fixing belt 26 experiences slippage in such a case and rotates at less than the predetermined circumferential speed Va of the pressure applying roller 19, the one-way clutch 77 transmits the rotational force of the motor 79 to the cylindrical rotation member 71. Accordingly, the fixing belt 26 is rotationally driven by the cylindrical rotation member 71 while the fixing belt 26 is sandwiched by the cylindrical rotation member 71 and the pressing roller 72. As a result, the fixing belt 26 smoothly rotates at the fixing nip N and the unfixed toner carried on the sheet of paper 9 is satisfactorily fixed.

Second Embodiment

Figure 5:
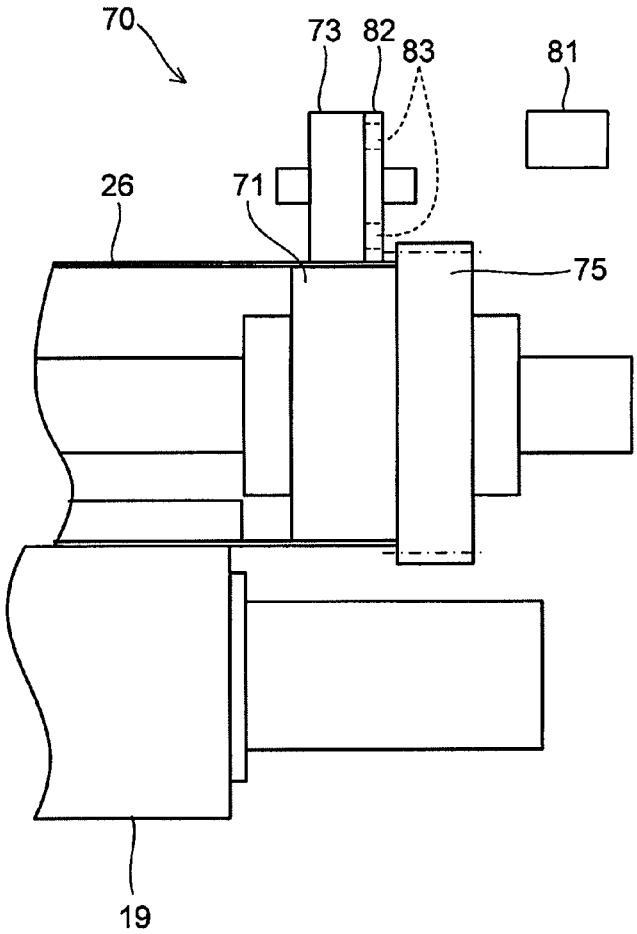
FIG. 5 is a partial side view illustrating a rotation detector provided at a belt drive assist mechanism according to a second embodiment of the present disclosure.

FIG. 5 is a partial side view illustrating a rotation detector provided at a belt drive assist mechanism 70 according to a second embodiment of the present disclosure. A setup of the rotation detector differing from the first embodiment will be focused on and descriptions related to items same as those of the first embodiment will be hereinafter omitted.

The rotation detector includes a light detecting sensor 81 and a detection plate 82 which is a target of light detection. The rotation detector detects rotation of a pressing roller 73 to determine whether a fixing belt 26 is rotating.

The detection plate 82 is attached to a side of the pressing roller 73 by bonding. The detection plate 82 is shaped like a disk having a plurality of slits 83 circumferentially. A side of the pressing roller 73 is treated to absorb light emitted by the light detection sensor 81. A surface of the detection plate 82 is treated to reflect the light emitted by the light detection sensor 81.

The light detection sensor 81 is arranged opposite to and adjacent to the detection plate 82 and includes a light emitting part and a light receiving part. The light emitting part emits light towards the detection plate 82. The receiving part receives light reflected off the detection plate 82.

The detection plate 82 rotates following rotation of the pressing roller 73. Each time the plurality of slits 83 faces the light detection sensor 81, the light receiving part of the light detection sensor 81 receives the light emitted from the light emitting part and reflected off the detection plate 82, thereby detecting pulses of light corresponding to the plurality of slits 83. When the light detection sensor 81 detects the pulses of light, the pressing roller 73 is determined to be in rotation. That is, the fixing belt 26 is determined to be in rotation while being driven by a pressure applying roller 19 or a cylindrical rotation member 71. When the fixing belt 26 is determined to be in rotation, an electric current is supplied to an exiting coil 37 such that an electromagnetic induction heating part 30 (see FIG. 2) causes the fixing belt 26 to initiate to inductively generate heat.

Since the setup described above does not cause the electromagnetic induction heating part 30 to heat the fixing belt 26 while stopping rotation, it is possible to prevent the fixing belt 26 from experiencing an abnormal temperature increase and damage.

In this connection, it may alternatively be possible for the rotation detector to adopt a plurality of through holes formed at a side of the pressing roller 73 as slits instead of using the detection plate 82. In addition, it may alternatively be possible to adopt a transparent optical sensor as the light detection sensor 81, in which a light emitting part and a light receiving part are arranged opposite to each other, in place of the reflective optical sensor according to the present embodiment. Furthermore, it may alternatively be possible for the rotation detector to adopt a device in place of the light detection sensor 81, in which rotation of the pressing roller 73 is mechanically or electromagnetically detected.

Third Embodiment

Figure 6:
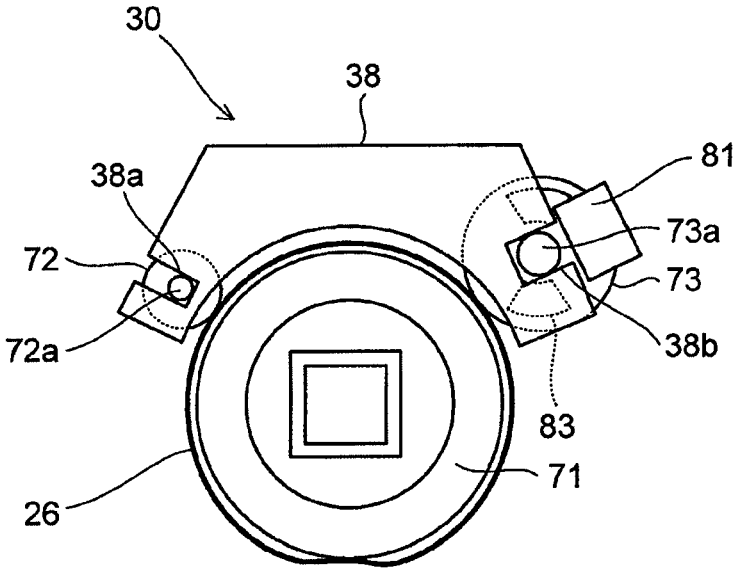
FIG. 6 is a plan view illustrating a pressing roller supported by a heating part according to a third embodiment of the present disclosure.

FIG. 6 is a plan view illustrating pressing rollers 72 and 73 supported by an electromagnetic induction heating part 30 according to a third embodiment of the present disclosure.

The electromagnetic induction heating part 30 includes an exciting coil 37 and a magnetic core 39 (see FIG. 2) to heat a fixing belt 26, and a supporting member 38 to support the exciting coil 37 and magnetic core 39.

The supporting member 38 is arranged spaced away from an outer surface of the fixing belt 26 at a predetermined distance and configured to cover substantially one half of an outer circumferential surface of the fixing belt 26. It may be that a heat resistant resin such as a liquid crystal polymer resin or the like is adopted for the supporting member 38 to cope with heat dissipated from the fixing belt 26.

Concave installation grooves 38*a* and 38*b* opening outward are formed at both peripheral ends of the supporting member 38. In addition, an aperture opposite to the fixing belt 26 is formed at the supporting member 38. The installation grooves 38*a* and 38*b* and the aperture are formed adjacent to an end of the fixing belt 26 with respect to a direction of a rotation shaft thereof (out-of-plane direction of FIG. 6).

A supporting shaft 72*a* of a pressing roller 72 (see FIG. 3) according to the first embodiment is rotatably installed in the installation groove 38*a*. An outer surface of the pressing roller 72 projects through the aperture of the supporting member 38 and faces the fixing belt 26. On the other hand, a supporting shaft 73*a* of a pressing roller 73 (see FIG. 5) according to the second embodiment is rotatably installed in the installation groove 38*b*. An outer surface of the pressing roller 73 projects through the aperture of the supporting member 38 and faces the fixing belt 26. A light detection sensor 81 is arranged opposite to slits 83 provided at the pressing roller 73. The light detection sensor 81 is attached to a main body (not illustrated) of a fixing device 5.

Since the two pressing rollers 72 and 73 are arranged spaced away from each other in a circumferential direction of the fixing belt 26, the fixing belt 26 stably rotates while being rotated following rotation of the cylindrical rotation member 71. In addition, since the fixing belt 26 loosely mated with the cylindrical rotation member 71 will not become loose between the two pressing rollers 72 and 73, there is no fear that the fixing belt 26 comes in contact with the supporting member 38 and suffers from damage.

Although an exemplary setup in which the belt drive assist mechanism 70 is arranged adjacent to the end of the fixing belt 26 with respect to the direction of the rotation shaft thereof has been described for the above first to third embodiment, the present disclosure is not limited to this setup. For example, it may alternatively be that belt drive assist mechanisms 70 are arranged adjacent to both ends of the fixing belt 26 with respect to the direction of the rotation shaft thereof. When the belt drive assist mechanisms 70 are arranged adjacent to both ends, it may be that one of the belt drive assist mechanisms 70 arranged adjacent to one end is configured to have a cylindrical rotation member 71 and a pressing roller 72 while eliminating a first gear member 75 and a second gear member 76. In this case, it may be preferable that the cylindrical rotation members 71 arranged adjacent to both ends are coupled with each other by a shaft 74 by which a driving force is transmitted.

Fourth Embodiment

Figure 7:
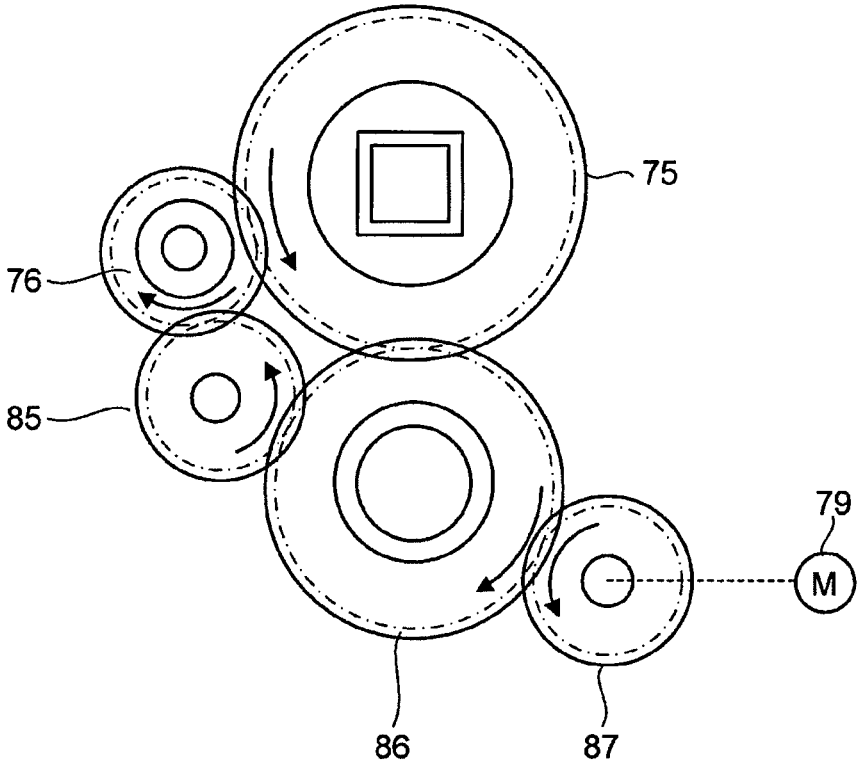
FIG. 7 is a plan view illustrating a belt drive assist mechanism according to a fourth embodiment of the present disclosure.

FIG. 7 is a plan view illustrating an arrangement of a plurality of gears of a belt drive assist mechanism 70 according to a fourth embodiment of the present disclosure.

As described above, a first gear member 75 integral with a cylindrical rotation member 71 meshes with a second gear member 76 which builds in a one-way clutch 77. An idler gear 85 meshes with the second gear member 76 and a third gear member 86 meshes with the idler gear 85. In addition, the third gear member 86 meshes with a relay gear 87 which is rotationally driven by a motor 79.

The third gear member 86, which is configured to be integral and coaxial with a pressure applying roller 19 (see FIG. 3), rotates in an opposite direction with respect to the first gear member 75. Accordingly, the pressure applying roller 19 and the cylindrical rotation member 71 rotate reversely with each other by rotational driving applied by the motor 79. As a result, a rotational direction of a fixing belt 26 while being rotationally driven by the pressure applying roller 19 agrees with a rotational direction of the fixing belt 26 while being rotationally driven by the cylindrical rotation member 71.

It should be noted that although an example employing the electromagnetic induction heating part 30 as a heating part has been described for the first to fourth embodiment, the present disclosure is not limited to this example. For example, it may be that a halogen lamp and the like are used as a heating part.

It may be that the present disclosure is applicable not only to a fixing device which is used for an image forming apparatus such as a copying machine, printer, facsimile, and multifunction peripheral having functions thereof, but also to an image forming apparatus provided with the fixing device. In particular, it may be that the present disclosure is applicable to a fixing device of a type in which a fixing belt is in pressure contact with a pressure applying roller by a pressing member and an image forming apparatus provided with such a fixing device.

The invention claimed is:

1. A fixing device comprising:

an endless fixing belt heated by a heating part;

a pressing member disposed on a side of an inner surface of the fixing belt, the inner surface configured to slide along an outer surface of the pressing member;

a pressure applying roller configured to press the pressing member to form a fixing nip at which the fixing belt is interposed and rotationally driven; and a belt drive assist mechanism disposed outside a nip region of the fixing nip and configured to rotationally drive the fixing belt, wherein the heating part comprises:

a coil bent like a loop in an axial direction of the fixing belt and configured to generate a magnetic flux to inductively heat the fixing belt; and a magnetic core disposed adjacent to the coil and configured to guide the magnetic flux to a layer of the fixing belt which is induced to generate heat, wherein the belt drive assist mechanism comprises:

a cylindrical rotation member configured to be rotationally driven by a drive source;

a pressing roller; and a rotation detector configured to detect whether the fixing belt is rotating by detecting rotation of the pressing roller, wherein the cylindrical rotation member is configured to be in contact with the inner surface of the fixing belt and to have an outer circumferential surface, a diameter of which is smaller than an inner diameter of the fixing belt for a case where the fixing belt is in a circular shape, wherein the pressing roller is configured to be in pressure contact with the cylindrical rotation member while interposing the fixing belt therebetween and to rotate following rotation of the fixing belt that is driven by the cylindrical rotation member or the pressure applying roller, and wherein the rotation detector comprises:

a detected part including a plurality of slits disposed circumferentially on a side surface of the pressing roller and configured to rotate in unison with the pressing roller; and a light detecting sensor configured to emit light from a light emitting part to the detected part and to receive light reflected off the detected part by a light receiving part.

2. The fixing device according to claim 1, wherein the belt drive assist mechanism comprises a one-way clutch, wherein the one-way clutch is disposed between the cylindrical rotation member and the drive source, the one-way clutch is configured not to transmit a rotational force applied by the drive source to the cylindrical rotation member when the fixing belt is driven to rotate at a predetermined circumferential speed substantially equal to a circumferential speed of the pressure applying roller, and the one-way clutch is configured to transmit the rotational force applied by the drive source to the cylindrical rotation member when the fixing belt is driven to rotate at less than the predetermined circumferential speed.

3. The fixing device according to claim 1, wherein the heating part comprises a supporting member to which the coil and the magnetic core are attached and the pressing roller is rotatably supported by the supporting member.

4. An image forming apparatus comprising a fixing device according to claim 1.

5. A fixing device comprising:

an endless fixing belt heated by a heating part which comprises a coil bent like a loop in an axial direction of the fixing belt and configured to generate a magnetic flux to inductively heat the fixing belt, a magnetic core disposed adjacent to the coil and configured to guide the magnetic flux to a layer of the fixing belt which is induced to generate heat, and a supporting member to which the coil and the magnetic core are attached and the pressing roller is rotatably supported by the supporting member;

a pressing member disposed on a side of an inner surface of the fixing belt, the inner surface configured to slide along an outer surface of the pressing member;

a pressure applying roller configured to press the pressing member to form a fixing nip at which the fixing belt is interposed and rotationally driven; and a belt drive assist mechanism disposed outside a nip region of the fixing nip and configured to rotationally drive the fixing belt, wherein the belt drive assist mechanism comprises:

a rotation detector configured to detect whether the fixing belt is rotating by detecting rotation of the pressing roller;

a cylindrical rotation member configured to be rotationally driven by a drive source; and a pressing roller;

wherein the cylindrical rotation member is configured to be in contact with the inner surface of the fixing belt and to have an outer circumferential surface, a diameter of which is smaller than an inner diameter of the fixing belt for a case where the fixing belt is in a circular shape, wherein the pressing roller is configured to be in pressure contact with the cylindrical rotation member while interposing the fixing belt therebetween and to rotate following rotation of the fixing belt that is driven by the cylindrical rotation member or the pressure applying roller;

wherein the pressing roller comprises one roller and the other roller, the one roller and the other roller are located circumferentially spaced away each other, and the rotation detector detects rotation of the one roller.

6. A fixing device comprising:

an endless fixing belt heated by a heating part;

a pressing member disposed on a side of an inner surface of the fixing belt, the inner surface configured to slide along an outer surface of the pressing member;

a pressure applying roller configured to press the pressing member to form a fixing nip at which the fixing belt is interposed and rotationally driven; and a belt drive assist mechanism disposed outside a nip region of the fixing nip and configured to rotationally drive the fixing belt, wherein the belt drive assist mechanism comprises a one-way clutch, wherein the one-way clutch is disposed between a cylindrical rotation member and a drive source, the one-way clutch is configured not to transmit a rotational force applied by the drive source to the cylindrical rotation member when the fixing belt is driven to rotate at a predetermined circumferential speed substantially equal to a circumferential speed of the pressure applying roller, and the one-way clutch is configured to transmit the rotational force applied by the drive source to the cylindrical rotation member when the fixing belt is driven to rotate at less than the predetermined circumferential speed wherein the belt drive assist mechanism comprises:

the cylindrical rotation member configured to be rotationally driven by the drive source;

a pressing roller; and wherein the cylindrical rotation member is configured to be in contact with the inner surface of the fixing belt and to have an outer circumferential surface, a diameter of which is smaller than an inner diameter of the fixing belt for a case where the fixing belt is in a circular shape, wherein the pressing roller is configured to be in pressure contact with the cylindrical rotation member while interposing the fixing belt therebetween and to rotate following rotation of the fixing belt that is driven by the cylindrical rotation member or the pressure applying roller, and wherein the belt drive assist mechanism further comprises:

a first gear member coaxially integral with the cylindrical rotation member; and a second gear member meshing with the first gear member and rotationally driven by the drive source via a rotation shaft, wherein the one-way clutch is disposed between a gear part of the second gear member and the rotation shaft.

7. The fixing device according to claim 6, wherein a third gear member configured to rotationally drive the pressure applying roller is arranged between the second gear member and the drive source.

* * * * *